US009717295B2

(12) United States Patent
Nyberg

(10) Patent No.: US 9,717,295 B2
(45) Date of Patent: Aug. 1, 2017

(54) LIGHTED VISOR AND METHOD OF RETROFITTING A PROTECTIVE SUIT

(71) Applicant: Ansell Limited, Richmond, Victoria (AU)

(72) Inventor: Hans Anders Jakob Everest Nyberg, Lund (SE)

(73) Assignee: Ansell Limited, Victoria (AU)

( * ) Notice: Subject to any disclaimer, the term of this patent is extended or adjusted under 35 U.S.C. 154(b) by 0 days.

(21) Appl. No.: 13/938,817

(22) Filed: Jul. 10, 2013

(65) Prior Publication Data

US 2014/0111977 A1 Apr. 24, 2014

Related U.S. Application Data

(60) Provisional application No. 61/715,532, filed on Oct. 18, 2012.

(51) Int. Cl.

| | |
|---|---|
| ***A42B 3/04*** | (2006.01) |
| ***A41D 13/11*** | (2006.01) |
| *F21V 33/00* | (2006.01) |
| *F21V 21/084* | (2006.01) |
| *A62B 17/00* | (2006.01) |
| *A62B 18/08* | (2006.01) |

(52) U.S. Cl.

CPC ..... *A42B 3/0446* (2013.01); *A41D 13/1184* (2013.01); *A62B 17/006* (2013.01); *A62B 18/082* (2013.01); *F21V 21/084* (2013.01); *F21V 33/0008* (2013.01)

(58) Field of Classification Search

CPC ..... A62B 17/003; A62B 17/006; A62B 17/04; A42B 1/244; A42B 3/044; A61F 9/04; A41D 13/1184; F21V 21/084; F21V 21/0808; F21V 33/0008

USPC ..... 362/105, 106; 2/457, 410, 424, 209.13, 2/901, 902, 905, 906

See application file for complete search history.

(56) References Cited

U.S. PATENT DOCUMENTS

| | | | | | |
|---|---|---|---|---|---|
| 3,787,113 | A | * | 1/1974 | Shedrow | 351/43 |
| 4,047,249 | A | * | 9/1977 | Booth | A42B 3/24 2/10 |
| 5,162,696 | A | * | 11/1992 | Goodrich | 313/511 |
| 5,193,895 | A | * | 3/1993 | Naruke et al. | 362/542 |
| 5,241,457 | A | * | 8/1993 | Sasajima | B60Q 1/2696 362/240 |

(Continued)

FOREIGN PATENT DOCUMENTS

| | | | | | |
|---|---|---|---|---|---|
| CN | 101120902 | A | | 2/2008 | |
| DE | EP2392384 | A1 | * | 12/2011 | A42B 1/24 |

(Continued)

OTHER PUBLICATIONS

Ocean Reef SDVL Shield Display &Visor Light, see attached pdf, https://web.archive.org/web/20090421162827/http://www.oceanreefgroup.com/products/accessories/products_sdvl.html; see attached pdf, "Ocean Reef."*

(Continued)

*Primary Examiner* — Andrew Couglin
*Assistant Examiner* — Colin Cattanach
(74) *Attorney, Agent, or Firm* — Moser Taboada

(57) ABSTRACT

A lighted visor and method of retrofitting a protective suit with a lighted visor are disclosed. The lighted visor includes a shield and at least one light source that is conformable to the shape of the shield or visor on which is it disposed.

20 Claims, 5 Drawing Sheets

(56) References Cited

U.S. PATENT DOCUMENTS

| | | | | |
|---|---|---|---|---|
| 5,337,225 | A * | 8/1994 | Brookman | 362/145 |
| 5,400,225 | A * | 3/1995 | Currie | B60Q 1/0011 340/468 |
| 5,559,681 | A * | 9/1996 | Duarte | F21V 21/08 362/231 |
| 5,564,128 | A * | 10/1996 | Richardson | A42B 3/044 2/422 |
| 5,671,483 | A * | 9/1997 | Reuber | 2/424 |
| 6,611,966 | B1 * | 9/2003 | Yamamoto et al. | 2/436 |
| 7,147,319 | B2 * | 12/2006 | Lin | 351/51 |
| 7,161,116 | B2 * | 1/2007 | Steinemann | 219/147 |
| 7,192,151 | B2 * | 3/2007 | Clupper et al. | 362/105 |
| 7,220,011 | B2 * | 5/2007 | Hurwitz | 362/84 |
| RE39,790 | E * | 8/2007 | Fuchs et al. | 428/336 |
| 7,341,361 | B2 * | 3/2008 | Gagne | 362/249.12 |
| 7,520,630 | B2 * | 4/2009 | Murphy | 362/105 |
| 7,735,156 | B2 * | 6/2010 | VanDerWoude et al. | 2/410 |
| 7,814,578 | B2 | 10/2010 | Kosel et al. | |
| 7,891,025 | B2 * | 2/2011 | Kobayashi et al. | 2/436 |
| 8,247,077 | B2 | 8/2012 | Danielsson | |
| 8,268,451 | B2 | 9/2012 | Danielsson | |
| 8,884,502 | B2 * | 11/2014 | Aurongzeb et al. | 313/110 |
| 2005/0047116 | A1 | 3/2005 | Gagne | |
| 2006/0232955 | A1 | 10/2006 | Labine | |
| 2007/0028372 | A1 | 2/2007 | VanDerWoude et al. | |
| 2007/0115651 | A1 * | 5/2007 | Murphy | A62B 18/08 362/103 |
| 2012/0002417 | A1 * | 1/2012 | Li | 362/249.02 |
| 2012/0131730 | A1 | 5/2012 | Shoham et al. | |
| 2012/0198603 | A1 | 8/2012 | Gertsch et al. | |
| 2012/0243210 | A1 | 9/2012 | Brown | |

FOREIGN PATENT DOCUMENTS

| | | | | |
|---|---|---|---|---|
| DE | EP2392384 | A1 * | 12/2011 | A62B 17/04 |
| EP | 2392384 | A1 | 12/2011 | |
| EP | 2392384 | A1 | 12/2011 | |
| EP | 2392384 | B1 | 7/2013 | |
| KR | 200450780 | Y1 | 10/2010 | |
| KR | 101046118 | B1 | 2/2011 | |
| KR | 2012-0002372 | | 4/2012 | |
| KR | 20120085595 | A | 8/2012 | |

OTHER PUBLICATIONS

Altinger, EP2392384 A1 Translation.*

International Search Report and Written Opinion mailed Oct. 29, 2013 for Application No. PCT/AU2013/000885.

Supplementary European Search Report mailed on May 9, 2016.

Australian Patent Examination Report dated Nov. 10, 2016 for Patent Application No. 2013332244.

* cited by examiner

LIGHTED VISOR AND METHOD OF RETROFITTING A PROTECTIVE SUIT

CROSS REFERENCE TO RELATED APPLICATIONS

This application claims the benefit of U.S. Provisional Patent Application, Ser. No. 61/715,532, filed Oct. 18, 2012, which is hereby incorporated by reference in its entirety.

BACKGROUND

Field

Embodiments of the present invention generally relate to protective articles and, more particularly, to lighted visors for use with personal protective equipment (PPE), such as protective suits.

Description of the Related Art

Personal protective equipment, such as suits made of protective garments, is used for protecting people from a hazardous environment in various conditions. Depending on the conditions, protective suits have one or more protective properties, such as chemical resistance, abrasion resistance, flexibility, flex cracking resistance, tear resistance, tensile strength, burst strength, puncture/cut resistance, seam strength, and resistance to ignition and flammability, and the like. Moreover, certain suits are used for medical situations, i.e., to prevent infection from pathogens and exposure to microbes, bacteria, viruses, and the like. Among various features of such protective suits, it is imperative that while wearing the suits, the users can see well in various situations, such as during fire and rescue, defense and military, police responses, hazmat, chemical remediation, biological material remediation, exposure to hazardous gases, and other various industrial situations. Accordingly, visors for use with such suits are required to provide protection for the head and neck of the wearer, while maintaining clear lines-of-sight and vision.

Accordingly, materials for visors must be transparent, which limits the available design options. An additional problem is that designers often must trade off various chemical and physical properties when designing visors for protective suits. For example, visors can become easily scratched, crazed from exposure to liquid chemicals, gaseous chemicals, ultraviolet light, and other environmental factors. Unfortunately, no transparent material can capably provide all of these properties. Further, such suits are often used in low light conditions and, therefore, providing a light source is important. However, it is generally preferable that personnel wearing suits have their hands available for the task at hand instead of having to operate a light source, such as handheld flashlights. Past attempts to solve this problem have provided lights on helmets. However, past solutions are poorly suited for use due to a lack of space. For example, space around the head of the wearer is needed to accommodate helmets, breathing apparatus, face masks, and the like, leaving little room for lighting equipment.

Additionally, in past arrangements, lights shine light onto the surface of the visor, reflecting back into the helmet and to the eyes of the wearer of such suits, reducing the vision of the wearer, particularly when the external conditions are dark. Other past attempts at solving this problem have provided lights attached to the outside of masks, helmets, and the like. Such constructions are not favored because the lights can become mechanically damaged or damaged due to exposure to harsh chemicals during use and, additionally, although suits are, optionally, reusable, in any event, they must be decontaminated before reuse. Decontamination is typically performed using harsh chemicals, which can render the lighting equipment used as light source non-functional. Also, because of the enclosed, typically air-tight, nature of protective suits, fog from perspiration of the wearer often develops on visors. To date, no solution provides remedies for all problems associated with a lighted visor for use with protective suits.

Therefore, there is a need in the art for a visor having a light source for use with a protective suit without the previously mentioned drawbacks.

SUMMARY

Embodiments of the invention include an apparatus providing a lighted visor for a protective suit, substantially as shown in and/or described in connection with at least one of the figures, as set forth more completely in the claims, is disclosed. Various advantages, aspects, and novel features of the present disclosure, as well as details of an exemplary embodiment thereof, will be more fully understood from the following description and drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. It is to be understood that elements and features of one embodiment may be in other embodiments without further recitation. It is further understood that, where possible, identical reference numerals have been used to indicate comparable elements that are common to the figures.

DETAILED DESCRIPTION

Embodiments in accordance with the present invention provide a lighted visor, for example, for use with personal protective equipment, such as encapsulating protective suits, made from protective garments, such as those disclosed in U.S. Pat. Nos. 8,247,077 and 8,268,451, which are herein incorporated by reference in their entireties. Protective suits can be used, for example, by personnel during emergency, fire and rescue, medical, industrial, and other safety hazard situations. Embodiments of the present invention also provide a lighted visor retrofit kit, and a method for retrofitting the lighted visor to protective suits. The lighted visor comprises a conformable light source for use with various protective suits.

The lighted visor is designed such that the light source does not obstruct the view of the wearer, and creates no or negligible obstructions for other items, equipment or body parts within the protective suit. Further, lighted visors in accordance with embodiments of the invention are designed such that light from the light source does not obstruct the view of the wearer by virtue of reflection from other parts of the visor, or directly from the light source, into the eyes of the wearer. Furthermore, embodiments of the invention enhance visibility for the wearer by providing light while keeping the wearer's hands free for work activities.

Figure 1:
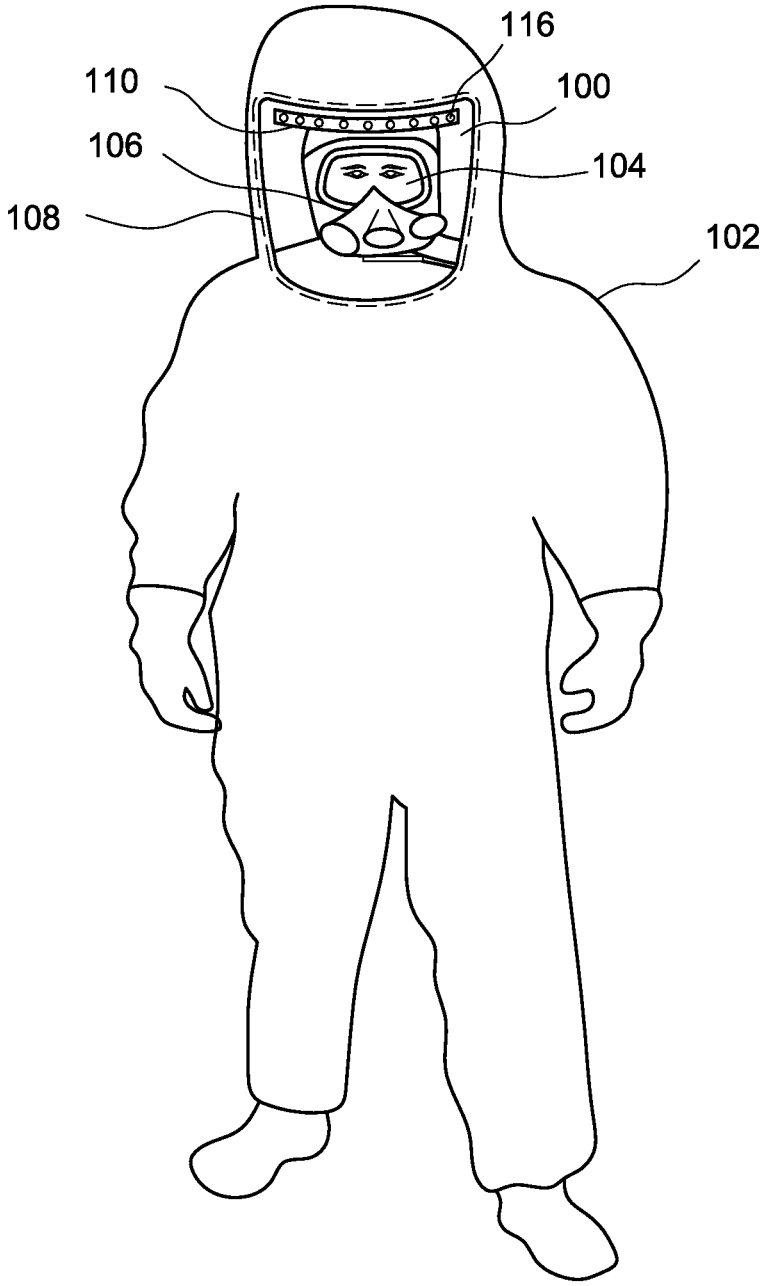
FIG. 1 depicts a lighted visor within personal protective equipment, according to embodiments of the present invention.

FIG. 1 depicts a lighted visor 100 within personal protective equipment, according to embodiments of the present invention. Personal protective equipment, such as a protective suit 102 having the visor 100, is worn, for example, by a person 104, wearing additional gear or equipment 106 in the close proximity to the face of the person 104. The person 104 and the additional gear, such as, for example, face mask and helmet 106 are internal to the suit 102 and the visor 100.

The visor 100 is attached to the suit 102 at an attachment area 108, which is along the periphery of the visor 100. The attachment area 108 provides for attaching visor 100 to the suit 102, while maintaining compliance with safety standards required to operate the suit 102. The visor 100 may be attached to the suit 102 by various attachment means, such as those known to one of ordinary skill in the art, including but not limited to, for example, adhesive such as a glue, thermal seal, and the like. In some embodiments, the attachment means include VELCRO®, stitches, and attachment means generally known in the art. According to various embodiments, the visor 100 further comprises a light source 110 for providing light to enhance the vision of the wearer 104, while preventing the light generated by the light source 110 to go directly, or by way of reflection from the visor 100, into the eyes of the wearer 104, as discussed in further detail below. The light source 110, such as one or more light emitting diodes 116 and/or other light sources, is generally disposed on an interior surface of the visor 100 such that the light source 110 is internal to the visor 100, for example, on the same side as the wearer 104. The light source 110 is generally powered using a power source, such as those generally known in the art, including but not limited to, a battery (not shown) disposed within or on the suit 102. Additionally, the light source 110 is detachable and may be re-applied to the shield 112, so that it need not be subjected to the same decontamination procedures as the rest of shield 112 or suit 102, providing less wear and allowing an extended life.

Figure 2:
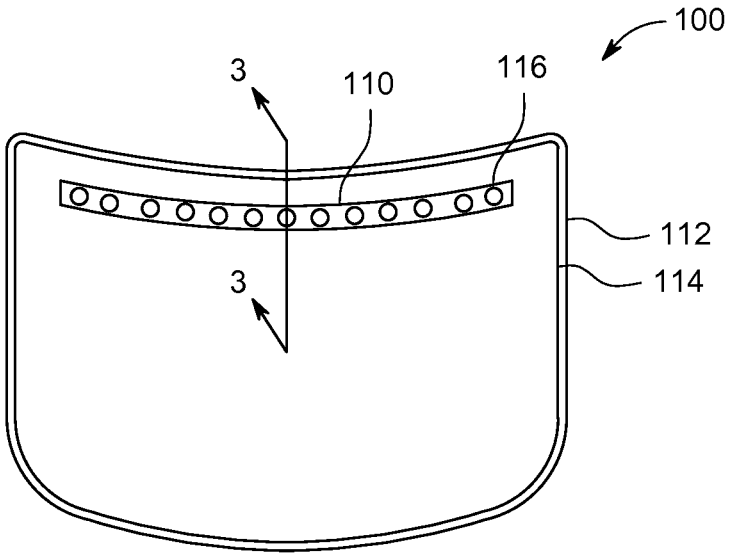
FIG. 2 depicts a lighted visor, according to embodiments of the present invention.

FIG. 2 depicts a lighted visor 100, according to embodiments of the present invention. The lighted visor 100 comprises a shield 112, a light source 110 disposed internal to the shield 112, and optionally, a protective removable lens 114 disposed on the exterior surface of the shield 112. The light source 110 comprises one or more LEDs 116. Embodiments according to the invention also comprise where the light source 110 includes a flexible circuit conformable to the shape of the shield 112. In some embodiments, the light source 110 is a flexible circuit coupling the one or more LEDs 116. As discussed above, embodiments according to the invention include wherein the light source 110 is detachable and re-applied to the shield 112, so that it is not be subjected to the same decontamination procedures as the rest of shield 112 or suit 102, providing less wear and allowing an extended life.

The shield 112 may be made of material suitable for use in hazardous environments, for example, an impact resistant and/or chemical resistant poly(vinyl chloride), biaxially-oriented polypropylene, polystyrene, polycarbonate, polymethyl methacrylate (PMMA) or other transparent polymer and/or ceramics. The shield 112 is generally convex as observed from outside the suit in which it might be incorporated. The shield 112 may be of any suitable thickness. For example, according to several embodiments, the thickness of the shield 112 varies from about 1 mm to about 10 mm. Also, the shield 112 may be made in different shapes for incorporation with different suit designs. For example, in some suits, the shield 112 may be relatively flat, while in other suits, such as suits requiring a high degree of peripheral vision, the shield 112 may have a smaller radius of curvature.

In some embodiments, the shield 112 comprises one or more of a polarized lens or a polarized coating, a tinted lens, or a coating, for example, to protect the wearer from bright and/or ultraviolet light, as are known to those of ordinary skill in the art. In at least one embodiment of the invention, the shield 112 has a thickness of about 2 mm. In some embodiments, the shield 112 has a multi-layered construction (not shown). In such embodiments, the shield 112 has a substantially transparent dual-sided adhesive disposed between any two shield layers. An additional shield layer (not shown), optionally of a different material, may provide additional functionality, increasing the protection for the wearer.

As discussed above, the visor 100 optionally includes a removable lens 114, disposed on the outer surface of the shield 112. The removable lens 114 is a thin, flexible polymeric film adhered to the shield 112 by means of a substantially transparent adhesive (not shown) that allows for easy removal of an article adhered, such as by peeling off the article, as generally known in the art. According to several embodiments, the removable lens 114 is made of one of several different polymeric materials, for example, specific for various applications, and includes materials having one or more of chemical resistance properties, such as for polar and non-polar organic solvents, scratch resistance, anti-static, anti-reflective, ultraviolet light resistance, anti-fog properties and the like. Some suitable polymeric materials include polyurethanes, acrylics, such as poly(methyl methacrylate), poly(ethylene terephthalate), polycarbonate, vinyls, such as poly(vinyl chloride), and the like. In the event that the removable lens 114 loses suitable transparency, by virtue of being scratched, crazed from chemicals, or otherwise damaged, the removable lens 114 can be removed from the shield 112, for example, by peeling-off. The removal of the removable lens 114 reveals the shield 112, thereby allowing a clearer view for the person 104. In several embodiments, a new removable lens may be disposed on the shield 112 after a previous one has been removed.

Figure 3:
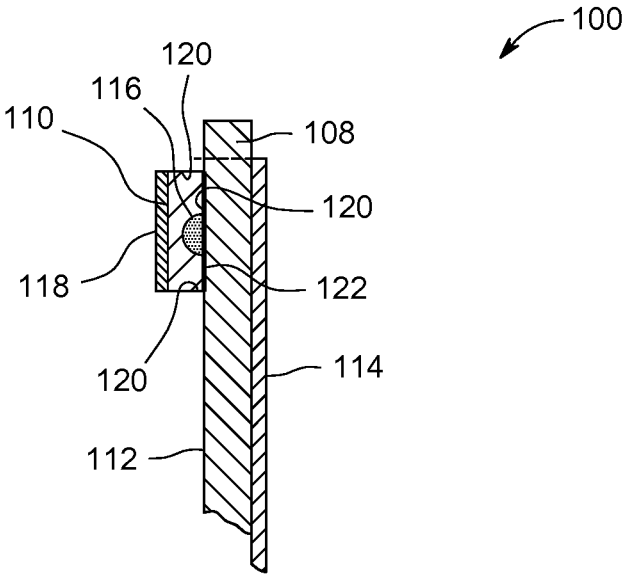
FIG. 3 depicts a cross section of the lighted visor taken along the line 3-3 of FIG. 2, according to embodiments of the invention.

FIG. 3 depicts a cross section of the lighted visor 100, taken along line 3-3, of FIG. 2, according to embodiments of the invention. The visor 100 comprises the shield 112, the light source 110, such as an LED 116, disposed on the interior surface of the shield 112, and an optional removable lens 114 disposed on the exterior surface of the shield 112. The shield 112 comprises an attachment area 108 along at least a portion of a periphery of the shield 112. The attachment area 108 is utilized for attaching the visor 100 or shield 112 to the suit 102. The light source 110 comprises a light emitting device, for example, a flexible circuit of light emitting diodes (LEDs). In some embodiments, alternative light sources may be used, such as incandescent bulbs or CFLs, as discussed below. According to some embodiments, an internal surface 120 of the light source 110 is reflective, and enhances the light emitted by the light source 110. The light source 110 further comprises a light barrier 118 preventing, substantially or completely, the light from the light source 110 from being emitted or reflected into the direction of the eyes of the person using the visor 100. The light barrier 118 is generally opaque and, according to some embodiments of the invention, includes opaque paint, a layer of opaque material such as an opaque spacer, an opaque casing, and the like.

In embodiments according to the invention, the light source 110 is attached or adhered to the shield 112 by a permanent or non-permanent adhesive 122 that is substantially transparent and thereby maximizes the light yield from the light source 110 to a region external to the visor 100, while maintaining the integrity of the light source 110 with respect to the shield 112. In some embodiments, the light source 110 is compliant and therefore conformable to the shape of the shield 112. In other words, in embodiments of the invention, the light source 110 is flexible so that it may be bent or otherwise fitted to the shape of the shield 112, when attached to either the shield 112 or the visor 100. Also, as illustrated, because of the proximity of the light source 110 to the shield 112, light does not reflect off the shield 112, or removable lens 114, into the eyes of a user. According to embodiments of the invention, the light source 110 is disposed below the attachment area 108 to avoid obstruction of light being emitted external to the shield 112, for example, by a portion of the suit 102. As discussed above, embodiments according to the invention include wherein the light source 110 is detachable and re-applied to the shield 112, so that it is not be subjected to the same decontamination procedures as the rest of shield 112 or suit 102, providing less wear and allowing an extended life.

According to various embodiments, the light source 110 comprises various light emitting devices For example, light emitting devices include, without limitation, light emitting diodes (LEDs), compact fluorescent lights (CFLs), ultraviolet lights, and other light or radiation emitting devices generally known in the art that are typically compact, lighter, and have a suitable radiation yield for a particular application. According to some embodiments of the invention, as discussed above, the light emitting devices are contained within a flexible circuit and are conformable to the shape of shields and/or visors. According to embodiments of the invention, the light emitting devices can be used without an external power source, such as a battery. In such embodiments, the light emitting device includes a power source internal to the light emitting device, as is known to persons having ordinary skill in the art. LEDs and CFLs are particularly useful because of their low power requirements.

Alternately, the visor 100 comprises a light source 110 comprising a plurality of light emitting diodes 116. The visor 100 comprises the shield 112, having an attachment area 108, upon which the light source 110, disposed on the interior of the shield 112, is adhered to the shield 112 by an adhesive 122, for example, wherein the plurality of light emitting diodes 116 are disposed within a double-sided tape 122, allowing the LEDs 116 to be conformably disposed on the shield 112. As stated above, in some embodiments of the invention, the LED or plurality of LEDs 116 comprise flexible circuits to assist in powering LEDs 116. According to various embodiments, even where the light source 110 is one or more LEDs 116, the light source 110 comprises a light barrier 118. The light barrier 118, includes opaque paint, a solid layer of opaque material, an opaque casing, and the like, which provides an opaque layer that completely or substantially prevents light from the light source 110 from shining directly or reflecting from the visor 100 into the interior of the visor 100.

Figure 4:
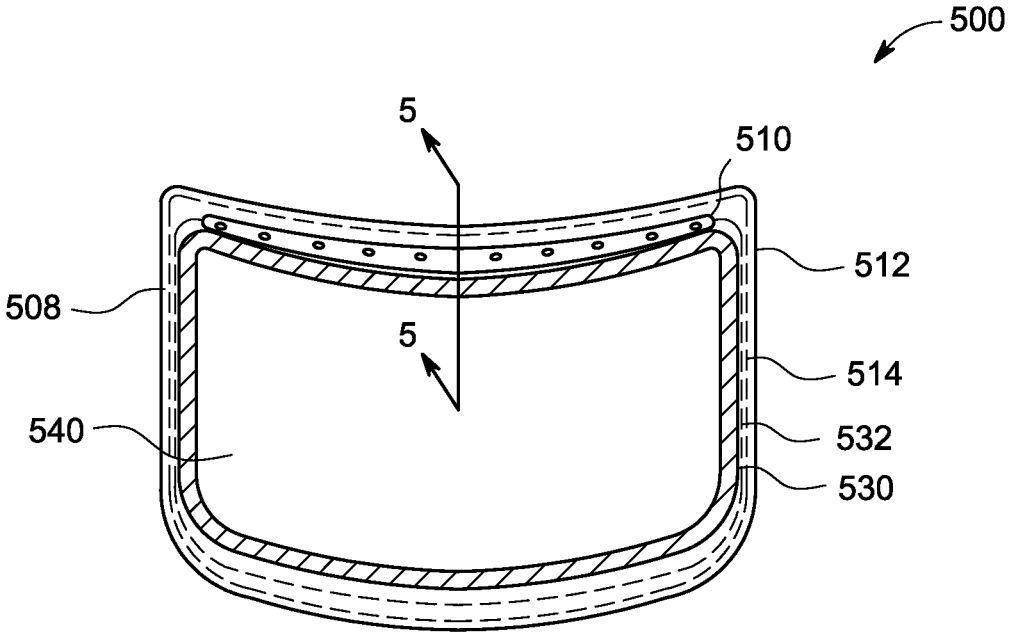
FIG. 4 depicts a lighted visor according to embodiments of the invention.

FIG. 4 depicts a lighted visor 500 according to embodiments of the invention. The visor 500 comprises a shield 512, an attachment area 508, a light source 510 comprising, for example, a flexible strip including a light source 510, of a plurality of LEDs 524 adhered to shield 512 by, for example, a substantially transparent adhesive, an opaque spacer 530, a lens 532 disposed internal to the shield 512, and, optionally, a removable lens 514. Embodiments of the invention include wherein the lens 532 is an antifog lens, as is discussed below.

The spacer 530 acts as a gasket, and is disposed by attachment means, such as adhesives, double sided adhesive tape, and glues, and the like known to those of skill in the art. Furthermore, the placement of the light source 510 outside a vision area 540 formed by the periphery of spacer 530 prevents emitted light from being reflected into the eyes of the wearer of the visor 500. Moreover, whereas the light source 510 comprises a small profile and is disposed between the shield 512 and the removable lens 514, additional gear that the wearer is wearing, such as a mask and helmet, as discussed above, cannot interfere with the light source 510. As discussed above, embodiments according to the invention include wherein the light source 510 is detachable and re-applied to the shield 512, so that it is not be subjected to the same decontamination procedures as the rest of shield 512, providing less wear and allowing an extended life.

Figure 5:
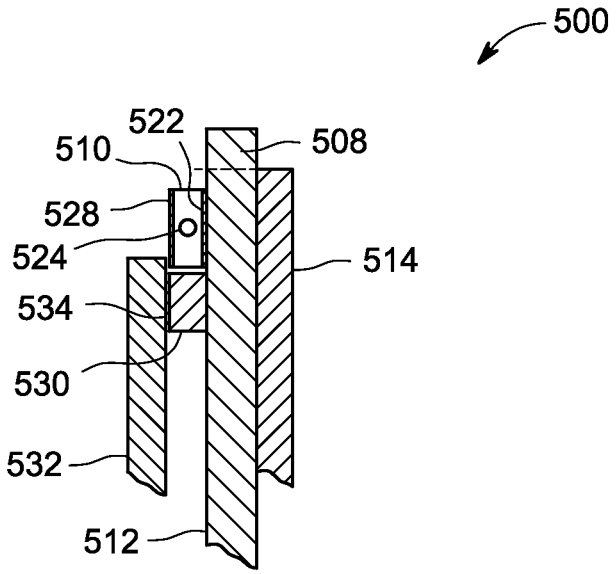
FIG. 5 depicts a cross section of the visor of FIG. 4 taken along line 5-5, according to embodiments of the invention.

FIG. 5 depicts a cross section of the lighted visor 500 of FIG. 4 taken along line 5-5, according to embodiments of the invention. The lens 532 is adhered to the spacer 530, for example, using an adhesive 534, such as those generally known in art. The lens 532 is generally flexible and conformable to the shape of the shield 512 when disposed on the spacer 530. As discussed above, having the light source 510 disposed between lens 532 shield 512 prevents additional equipment (not shown) from interfering with light source 510, allowing the wearer of visor 500 to have an unimpeded view. In some embodiments of the invention, the lens 532 is an anti-fog lens and enhances the performance of any visor disclosed herein by preventing or reducing fogging of the lens 532, caused by moisture, for example, the wearer's breath or perspiration. The lens 532 comprises a substantially transparent plastic sheet. Some suitable plastic sheet materials include polyurethanes, acrylics, such as poly(methyl methacrylate), poly(ethylene terephthalate), polycarbonate, vinyls, such as poly(vinyl chloride), and the like. The plastic sheet can be made to be antifog using antifog agents and treatments known to those in the art. The agents and/or treatments minimize surface tension of the plastic sheet, which attenuates or prevents the condensation of water, such as from the breath of a wearer of the suit. Instead, moisture spreads as an even film without forming the droplets that cause fogging. Suitable antifog agents and/or treatments, such as surfactant films, create a hydrophilic surface on the plastic sheet. The plastic sheet can be made antifog with internal additives, such as non-ionic surfactants. In some embodiments, the internal additives comprise alkoxylated ethers, sorbitan esters, polyoxyalkylene fatty acid esters, alkoxylated phenols, mixed mono-, di-, or triglycerides, fatty acid esters of polyhydroxy alcohols and other polyalkoxylated compounds. Alternately, the plastic sheet can be made antifog using a topical coating, such as cross-linked polymers cured on, for example, a poly(ethylene terephthalate) film.

According to embodiments of the invention, the lens 532 includes other properties, such as polarization, for protection against ultra-violet light as discussed above. The spacer 530 thus serves multiple purposes, by disposing performance enhancing the lens 532 and providing an obstruction to light originated from the light source 510 from being directed to the eyes of the wearer. The light source 510 optionally includes the light barrier 528. Additionally, the light source 510 may be adhered to the lens 532, the spacer 530, or the shield 512.

According to some embodiments, the light source 510 comprises a flexible strip comprising LEDs 524, the strip having the same or a lesser thickness than the spacer 530. In some embodiments of the invention, the flexible light source 510 traverses the entire periphery of the spacer 530 (light source along the entire periphery of the spacer 530 not shown) and therefore includes additional LEDs. Additional LEDs disposed in such a manner provide additional light, and because the light source 510 is disposed around the periphery of the curved shield 512, the light source 510 also increases the span of illumination, enhancing the wearer's peripheral vision.

Figure 6:
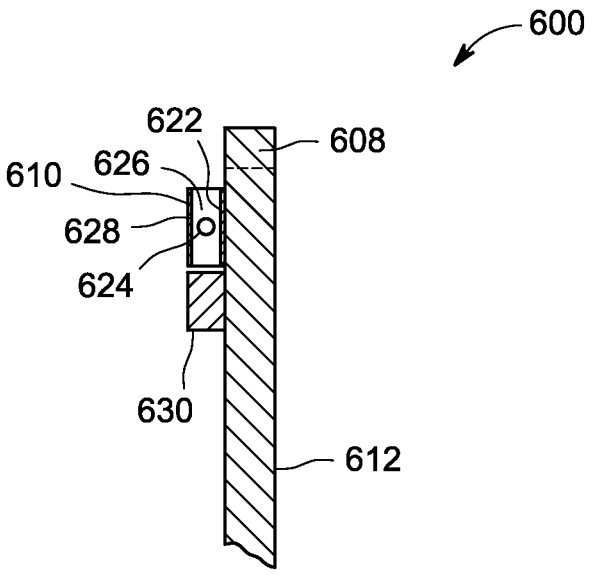
FIG. 6 depicts a cross section of an alternative lighted visor, according to one or more embodiments of the invention.

FIG. 6 depicts a cross section of a lighted visor 600, according to one or more embodiments of the invention. The visor 600 comprises a shield 612, having an attachment area 608, and a light source 610 disposed on the interior of the shield 612. The light source 610 is adhered to the shield 612 by an adhesive 622, for example, a substantially transparent adhesive, as described above. The light source 610 comprises one or more LEDs 624 disposed within a flexible casing 626, comprising flex circuits (not shown) to assist in powering the LEDs 624. According to various embodiments, the light source 610 comprises a light barrier 628. In some embodiments, the light barrier 628 is absent (not shown) because light generated by the LEDs 624 is not emitted or reflected in direction of the light barrier 628.

The visor 600 further comprises a light barrier 630 disposed on the interior surface of the shield 612. The light barrier 630 is opaque and comprises a compliant material which is disposed on the shield 612 by an adhesive, such as those generally known in the art. The light barrier 630, when disposed, has substantially the same radius of curvature as the shield 612, and is conformable to shape of the shield 612. In some embodiments, the light barrier 630 is a spacer 630 that may comprise silicone or comprise foamed polyurethane, chloroprene, or nitrile polymeric material or the like. The spacer 630 extends along the light source 610 on the inner surface of the shield 612, and extends inwards (for example, in the direction of a person who may wear protective suit) from the shield 612, to obstruct substantially, light emitted by the light source 610, or such light reflected by any part of the visor 600, to a wearer of a suit comprising the visor 600. In several embodiments, the light barrier 630 is positioned to obstruct such light completely. In embodiments of the invention, the light barrier 628, a light barrier 630 obstruct light originating from the light source 610 from being directed towards a wearer of a suit, for example, the suit 602. As discussed above, embodiments according to the invention include wherein the light source 610 is detachable and re-applied to the shield 612, so that it is not be subjected to the same decontamination procedures as the rest of shield 612 or suit 602, providing less wear and allowing an extended life.

In some embodiments of the invention, a spacer 630 is transparent (not shown), for example, the spacer 630 may be formed of the same material as the shield 612, and in such embodiments, the downward facing surface of the spacer 630 is made opaque by, for example, painting, surface etching, and the like.

Figure 7:
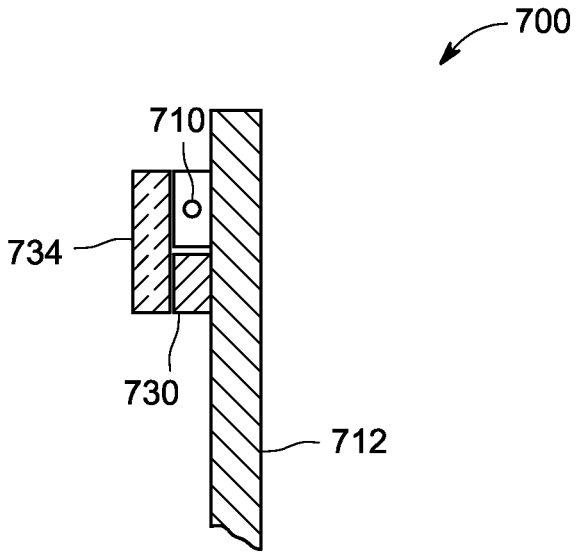
FIG. 7 depicts a cross section of an alternative lighted visor according to one or more embodiments of the invention.

FIG. 7 depicts a cross section of an alternative lighted visor 700 according to one or more embodiments of the invention. The visor 700 comprises a shield 712, and an opaque spacer 830 disposed on the interior surface of the shield 712 by means of an adhesive (not shown). Embodiments according to the invention comprise wherein the shield 712 has antifog properties, as discussed above. In such embodiments, an additional antifog lens is optional. In lighted visor 700, linkage element 734 comprises a light source 710, such as a flexible strip of LEDs as discussed above, and the spacer 730. The spacer 730 is adhered to a linkage element 734, for example, by means of adhesive (not shown), such that the spacer 730 is a gasket in between the shield 712 and the linkage element 734. The linkage element 734 extends beyond the spacer 730, for example, as illustrated in an upward direction. At least a portion of the linkage element 734 that extends beyond the spacer 730 is adhered to a light source 710 such that the light source 710 is disposed between the linkage element 734 and the shield 712, and is supported by the spacer 730. The light source 710 may or may not be adhered to the spacer 730, however, the spacer 730 is functional to obstruct light originating from the light source 710 to be emitted or reflected into a wearer's eyes. Additionally, the light source 710 may be adhered to the shield 712.

Figure 8:
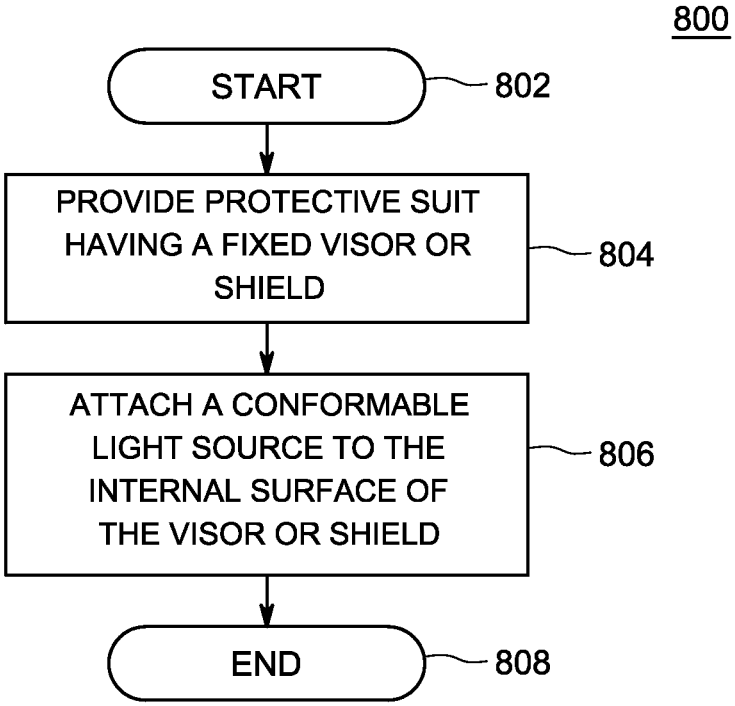
FIG. 8 depicts a method for retrofitting a lighted visor to a protective suit according to embodiments of the invention.

FIG. 8 depicts a method 800 for retrofitting a lighted visor to a protective suit according to embodiments of the invention. The method 800 starts at step 802, and proceeds to step 804 at which point a protective suit having a removable visor is provided. Embodiments according to the invention include a fixed visor that is non-detachable from the protective suit and is, for example, glued permanently to the protective suit. According to embodiments of the invention, the visor comprises a shield, for example a shield as discussed above.

Method 800 proceeds to step 806 at which point a conformable light source, for example, a flex circuit of LEDs, or other light source(s) disclosed herein, is attached to the inside surface of the shield or the visor. The light source is attached using, without limitation, adhesives, double sided adhesive tapes, glues, epoxies, and the like, such that the light generated is emitted substantially external to the shield. The method 800 proceeds to step 808 at which the method 800 ends. It is to be noted that some embodiments of the present invention may include additional steps. Furthermore, some steps may be omitted and/or performed in an order differing from the method described above.

For example, embodiments of the invention include the shield having a light barrier or a spacer that obstructs light originating from the light source from being directed toward a person wearing the protective suit. According to some embodiments, a lens is optionally attached to the shield through the spacer, such as a gasket or foamed material, is disposed between the shield and the lens. The gasket or foamed material is attached using without limitation, adhesives, double sided adhesive tapes, glues, epoxies, and the like. The lens comprises, for example, an anti-fog lens according to embodiments of the present invention as disclosed herein. The spacer is of any suitable thickness, for example, 0.5-10 mm, that is thicker than the conformable light source. In some embodiments of the invention, the gasket or foamed material is approximately 3-5 mm. Also, the spacer is optionally made of any opaque material to prevent light from being directed internally toward the eyes of the person wearing the protective suit.

The drawings and embodiments illustrated herein are representations, and not intended to provide scale or precise shape of one or more articles shown. The drawings are illustrative and alternates or equivalents of such articles will occur readily to one of ordinary skill in the art, without departing from the scope and spirit of the present invention. Therefore, while the foregoing is directed to embodiments of the invention, other embodiments of the invention may be devised without departing from the scope thereof, and the scope thereof is determined by the following claims.

The invention claimed is:

1. A lighted visor, comprising:

a transparent shield having an attachment area, defined along a periphery of the shield, wherein the attachment area is adapted for attaching the lighted visor to an encapsulating protective suit;

a compliant spacer conformably attached to an internal surface of the shield, wherein the compliant spacer is opaque and defines a vision area;

a transparent lens attached to the compliant spacer and internal to the shield, a compliant elongate light source that includes a flexible circuit and at least one light source, wherein the compliant elongate light source is conformably attached to at least one of the internal surface of the shield or an external surface of the lens, wherein the compliant spacer and the compliant elongate light source are disposed between the shield and the lens; and wherein the compliant elongate light source is disposed outside the vision area, the compliant spacer preventing all light generated by the compliant elongate light source from being emitted directly into the vision area from the compliant elongate light source, wherein the compliant spacer is at least as thick as a thickness of the compliant elongate light source.

2. The lighted visor of claim 1, wherein the compliant spacer is thicker than the compliant elongate light source.

3. The lighted visor of claim 1, wherein the compliant spacer comprises at least one of foamed material, metal, polymer, gasket, or glass.

4. The lighted visor of claim 1, wherein the shield is made of at least one of poly(vinyl chloride), biaxially-oriented polypropylene, polystyrene, polycarbonate, or polymethyl methacrylate (PMMA).

5. The lighted visor of claim 1, wherein the compliant spacer has a thickness of about 0.5 mm to about 5 mm.

6. The lighted visor of claim 1, wherein the at least one light source is a light emitting diode (LED).

7. The lighted visor of claim 1, wherein the transparent lens is an anti-fog lens.

8. The lighted visor of claim 1, further comprising a linkage element adhered to the spacer, wherein the compliant elongate light source is adhered to the linkage element, and wherein the compliant spacer and the compliant elongate light source are disposed between the transparent shield and the linkage element.

9. The lighted visor of claim 1, further comprising a removable lens disposed on the external surface of the transparent shield.

10. The lighted visor of claim 1, wherein the at least one source includes at least one or more of a LED, a compact fluorescent light (CFL), or an incandescent bulb.

11. The lighted visor of claim 1, wherein the compliant elongate light source emits light directed to illuminate a region external to the transparent shield.

12. A method for retrofitting an encapsulating protective suit, comprising:

attaching a compliant elongate light source, including a flexible circuit and at least one light source, on an internal surface of a shield having a given shape, a radius of curvature, and including a vision area therein adapted to face the eyes of a wearer of the protective suit, wherein the compliant elongate light source conforms to the given shape of the shield;

disposing a compliant spacer on the internal surface of the shield and adjacent to the compliant elongate light source, the compliant spacer defining a perimeter enclosing the vision area, wherein the compliant elongate light source is positioned outside the compliant spacer and the vision area, wherein the compliant spacer has a rectangular cross section having at least the same thickness as the compliant elongate light source, wherein the compliant spacer is opaque and configured to block all the light generated by the compliant elongate light source from being emitted directly into the vision area from the compliant elongate light source, and wherein the compliant elongate light source and the compliant spacer have the same radius of curvature as the internal surface of the shield;

disposing a lens on the spacer and internal to the shield, wherein the spacer and the elongate light source are disposed between the shield and the lens; and attaching the shield having the compliant elongate light source and the compliant spacer to the encapsulating protective suit at an attachment area, defined along a periphery of the shield.

13. The method of claim 12, wherein the compliant spacer is thicker than the compliant elongate light source.

14. The method of claim 12, wherein the shield is made of at least one of poly(vinyl chloride), biaxially-oriented polypropylene, polystyrene, polycarbonate, or polymethyl methacrylate (PMMA).

15. The method of claim 12, wherein the lighted visor is attached in a sealed configuration to the encapsulating protective suit along the attachment area, the encapsulating suit and lighted visor configured to enclose at least one of a helmet or a face mask completely.

16. The method of claim 12, wherein the compliant spacer has a thickness of about 0.5 mm to about 5 mm.

17. The method of claim 12, wherein the compliant elongate light source comprises an LED.

18. The method of claim 12, wherein the at least one light source comprises the flexible circuit including at least one of an incandescent bulb, compact fluorescent light (CFL), or a plurality of LEDs.

19. The method of claim 12, wherein the lens is at least one of an antifog, tinted, or polarized lens.

20. The method of claim 17, further comprising attaching a linkage element to the compliant spacer, wherein the compliant elongate light source is adhered to the linkage element, and wherein the compliant spacer and the compliant elongate light source are disposed between the shield and the linkage element.

* * * * *